US012605760B2

(12) United States Patent
Shorei et al.

(10) Patent No.: US 12,605,760 B2
(45) Date of Patent: Apr. 21, 2026

(54) LOW-PRESSURE CASTING APPARATUS

(71) Applicant: Nissan Motor Co., Ltd., Yokohama (JP)

(72) Inventors: Seigo Shorei, Kanagawa (JP); Giichirou Okamura, Kanagawa (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 18/861,623

(22) PCT Filed: May 2, 2022

(86) PCT No.: PCT/JP2022/019520
§ 371 (c)(1),
(2) Date: Oct. 30, 2024

(87) PCT Pub. No.: WO2023/214452
PCT Pub. Date: Nov. 9, 2023

(65) Prior Publication Data

US 2025/0256326 A1 Aug. 14, 2025

(51) Int. Cl.
*B22D 18/04* (2006.01)

(52) U.S. Cl.
CPC ..... *B22D 18/04* (2013.01)

(58) Field of Classification Search
CPC ..... B22D 18/04; B22C 9/062; B22C 9/064
See application file for complete search history.

(56) References Cited

U.S. PATENT DOCUMENTS 4,824,351 A * 4/1989 Ramsey ..... B29C 45/80 425/395
6,044,893 A * 4/2000 Taniguchi ..... B22D 17/2076 164/63
2015/0343520 A1 12/2015 Howell et al.

FOREIGN PATENT DOCUMENTS

| | | | |
|---|---|---|---|
| CN | 201677021 | U | 12/2010 |
| CN | 203508996 | U | 4/2014 |
| CN | 205496515 | U | 8/2016 |
| CN | 110695339 | A | 1/2020 |
| CN | 211000145 | U | 7/2020 |
| EP | 3305436 | A1 | 4/2018 |

(Continued)

OTHER PUBLICATIONS

English Machine Translation of WO 2016/185610 A1 (Year: 2016).*

(Continued)

*Primary Examiner* — Keith Walker
*Assistant Examiner* — Steven S Ha
(74) *Attorney, Agent, or Firm* — Spencer Fane LLP

(57) ABSTRACT

A low-pressure casting apparatus includes a lower mold disposed on a holding furnace, an upper mold configured to be raised and lowered relative to the lower mold, and a plurality of side molds disposed above the lower mold. A cavity is formed between the lower mold, the upper mold and the side molds. The lower mold includes a lower cast main part forming an inner bottom surface of the cavity, and a lower mold base part holding the lower cast main part. The lower cast main part has a sprue bushing that opens into the cavity. At least one of the side molds is advanceable and retractable relative to a mold center. The lower mold base part has guide pillars that restrict advanced positions of the side molds. The horizontal adjustment gap is provided between the lower cast main part and the lower mold base part.

5 Claims, 6 Drawing Sheets

(56) References Cited

FOREIGN PATENT DOCUMENTS

| | | | | | |
|---|---|---|---|---|---|
| JP | H1-109357 | U | | 7/1989 | |
| JP | H4-47838 | U | | 4/1992 | |
| JP | 2001286984 | A | * | 10/2001 | |
| JP | 2007-50435 | A | | 3/2007 | |
| JP | 2007-319891 | A | | 12/2007 | |
| JP | 2013-86118 | A | | 5/2013 | |
| JP | 2013086118 | A | * | 5/2013 | |
| JP | 2016-215243 | A | | 12/2016 | |
| JP | 2020-6375 | A | | 1/2020 | |
| KR | 20070001100 | A | * | 1/2007 | ..... B22D 18/04 |
| WO | WO-2016185610 | A1 | * | 11/2016 | ..... B22D 18/04 |

OTHER PUBLICATIONS

First Office Action received in Chinese Application No. 202280095491.5, mailed on Mar. 14, 2025, 14 pages. (English Translation Submitted).

Extended European Search Report received for EP Application No. 22940505.5, mailed on Jun. 2, 2025, 7 pages.

* cited by examiner

LOW-PRESSURE CASTING APPARATUS

CROSS-REFERENCE TO RELATED APPLICATIONS

This application is a U.S. national stage application of International Application No. PCT/JP2022/019520, filed on May 2, 2022.

BACKGROUND

Technical Field

The present invention relates to an improvement to a low-pressure casting apparatus.

Background Technology

An example of a prior-art low-pressure casting apparatus is described in Japanese Laid-Open Patent Application No. 2007-319891 (hereinafter referred to as Patent Citation 1). The low-pressure casting apparatus described in Patent Citation 1 comprises a lower mold disposed above a holding furnace, an upper mold that can be raised and lowered relative to the lower mold, and a plurality of horizontal molds that can be advanced and retracted above the lower mold with respect to a mold center. In the low-pressure casting apparatus, a cavity is formed between the lower mold, the lowered upper mold, and the advanced horizontal molds. The lower mold has a sprue that communicates with a stalk.

After the molds have been closed in the low-pressure casting apparatus, the inside of the holding furnace is pressurized, whereby molten metal in the holding furnace is passed through the stalk and the sprue and filled into the cavity. The low-pressure casting apparatus solidifies the molten metal in the cavity by cooling, and then opens the molds to release a cast article.

SUMMARY

Generally, in a low-pressure casting apparatus comprising a lower mold, an upper mold, and a horizontal mold, guide pillars that restrict an advanced position of the horizontal mold are disposed on the lower mold, and the temperature of the lower mold, which has a sprue, correspondingly increases. Therefore, in a prior-art low-pressure casting apparatus, the lower mold is prone to thermal expansion in the horizontal direction, and when thermal expansion occurs, positions of the guide pillars are displaced toward the outside of the molds, causing the advanced position of the horizontal mold to shift forward. As a result, in a prior-art low-pressure casting apparatus, there is a risk that a clearance-exceeding gap will be formed, particularly between the upper mold and the horizontal mold, and overcoming such drawbacks has been a problem.

The present invention was devised with focus on the problems with the prior art described above, it being an object of the invention to provide a low-pressure casting apparatus in which excessive gaps between casts caused by thermal expansion of the lower mold can be prevented, and improvements in mold-closing accuracy can be realized.

A low-pressure casting apparatus according to the present invention comprises a lower mold disposed over a holding furnace, an upper mold that can be raised and lowered relative to the lower mold, and a plurality of side molds disposed over the lower mold, a cavity being formed between the lower mold, the upper mold, and the side molds. The lower mold includes a lower cast main part that forms an inner bottom surface of the cavity, and a lower mold base part that holds the lower cast main part. The lower cast main part has sprue bushes that open into the cavity. At least one of the side molds can advance and retract relative to a mold center, and the lower mold base part has guide pillars that restrict advanced positions of the advanceable and retractable side molds. The low-pressure casting apparatus is characterized in that a horizontal adjustment gap is provided between the lower cast main part and the lower mold base part.

When casting is performed in the low-pressure casting apparatus comprising the configuration described above, the lower cast main part, which has the sprue bushes, correspondingly increases in temperature, and the lower cast main part thermally expands mainly in a horizontal direction. As a countermeasure, the lower mold of the low-pressure casting apparatus is divided into the lower cast main part and the lower mold base part and the adjustment gap is provided therebetween; therefore, the thermal expansion of the lower cast main part is absorbed by the adjustment gap, and thermal deformation of the lower mold base part is minimized. As a result, in the low-pressure casting apparatus, displacement of the guide pillars in the lower mold base part is prevented and the proper advanced positions of the advanceable and retractable side molds are ensured, and there will not be excessive gaps larger than clearance between the side molds and the upper mold.

Due to employing the configuration described above, the low-pressure casting apparatus according to the present invention can prevent excessive gaps between casts caused by thermal expansion of the lower mold, and can realize improvement in mold-closing accuracy.

BRIEF DESCRIPTION OF THE DRAWINGS

Referring now to the attached drawings which form a part of this original disclosure, selected embodiments are illustrated.

DETAILED DESCRIPTION OF EMBODIMENTS

First Embodiment

Figure 1:
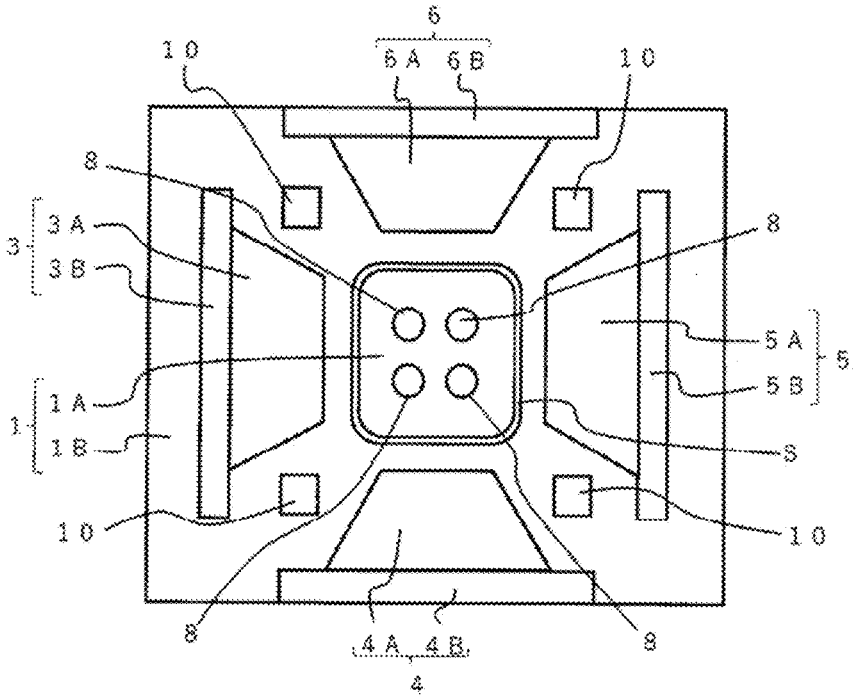
FIG. 1 is a plan view of a lower cast in an open state in a first embodiment of a low-pressure casting apparatus according to the present invention.
Figure 2:
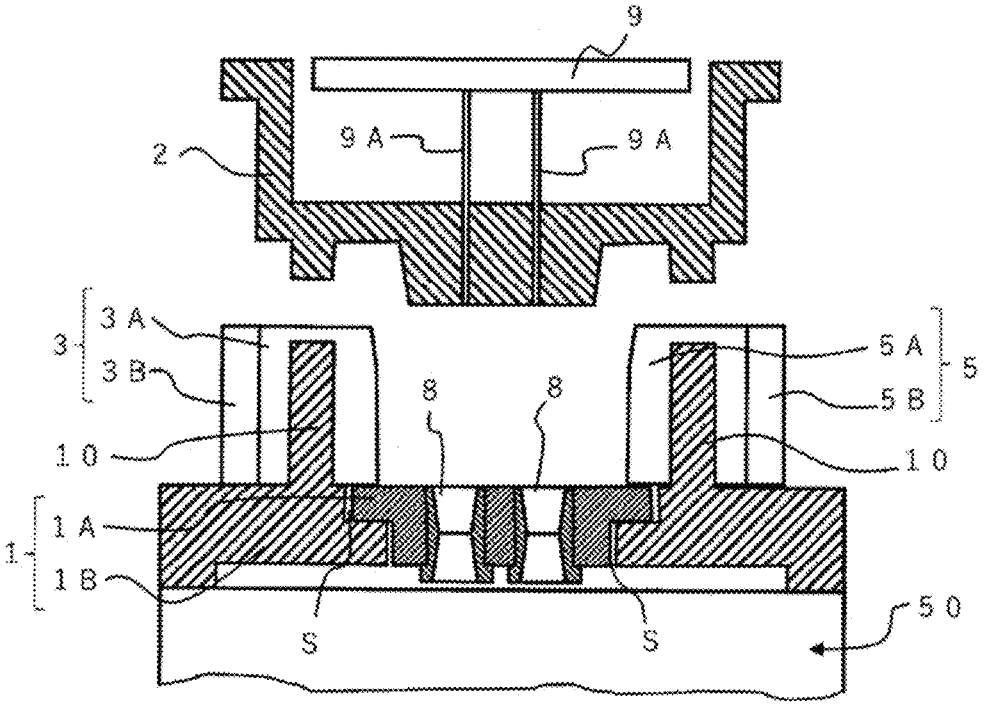
FIG. 2 is a vertical cross-sectional view of a mold-open state.
Figure 3:
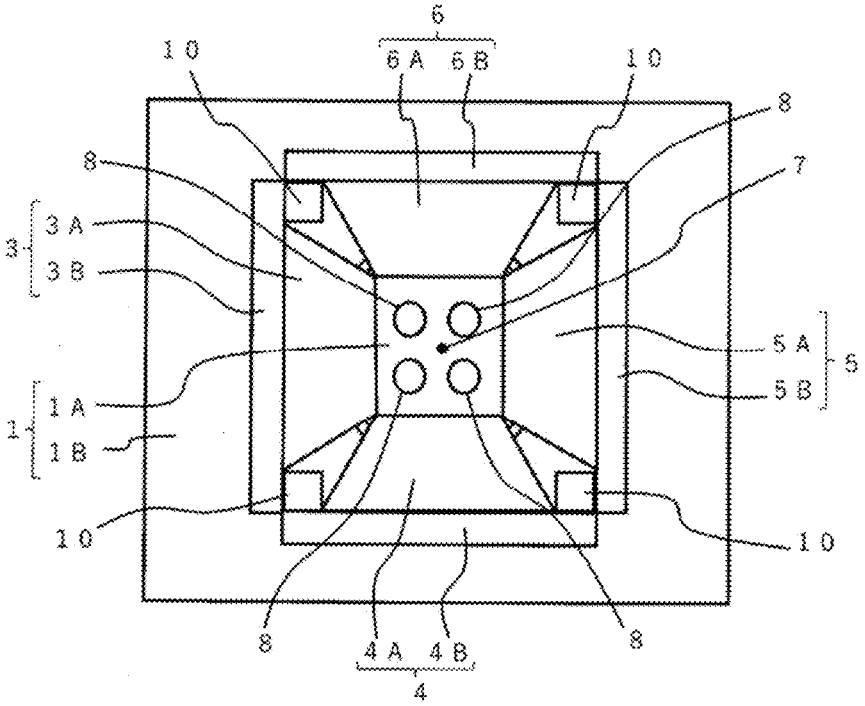
FIG. 3 is a plan view, continuing from FIG. 1, of a lower cast in a mold-closed state.
Figure 4:
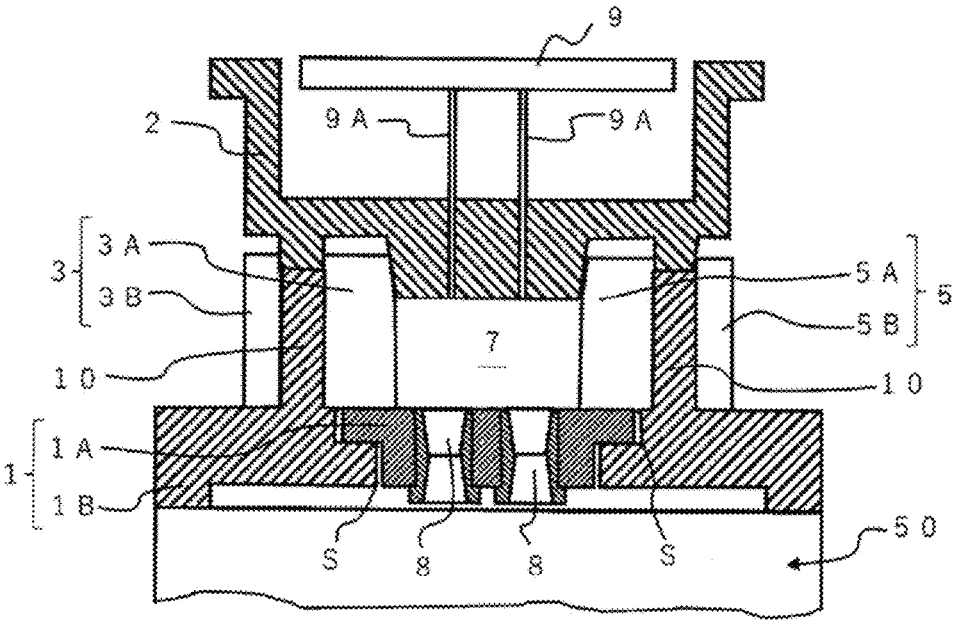
FIG. 4 is a vertical cross-sectional view, continuing from FIG. 2, of a mold-closed state.

A low-pressure casting apparatus shown in FIGS. 1 and 2 comprises a lower mold 1 disposed on a holding furnace 50, an upper mold 2 that can be raised and lowered relative to the lower mold 1, and a plurality (four in the illustrated example) of side molds 3 to 6 disposed on the lower mold 1. In the low-pressure casting apparatus, a cavity 7, which is a casting space, is formed between the lower mold 1, the upper mold 2, and the plurality of side molds 3 to 6, as shown in FIGS. 3 and 4. FIGS. 2 and 4 show only side molds 3 and 5, which are disposed on the left and right in the drawings.

The holding furnace 50, although not shown in detail, is a well-known type that stores molten metal and comprises a stalk which is a passage filled with the molten metal, an internal pressurizing mechanism, and the like.

The lower mold 1 comprises a lower cast main part 1A that forms an inner bottom surface of the cavity 7, and a lower mold base part (die base) 1B that holds the lower cast main part 1A. The lower cast main part 1A in the illustrated example describes a square shape in a plan view, and four sprue bushes 8 are arranged vertically and horizontally in the center. Lower parts of each of the sprue bushes 8 communicate with the stalk of the holding furnace 50, and upper parts open into the cavity 7.

In the lower mold 1 in the illustrated example, an outer periphery of the lower cast main part 1A has a downward-oriented step, the lower mold base part 1B has an upward-oriented step on an inner periphery of a portion accommodating the lower cast main part 1A, and the steps engage with one another. This allows the lower cast main part 1A and the lower mold base part 1B to be combined such that upper surfaces thereof are continuous in the same plane, and a horizontal adjustment gap S is provided therebetween.

The upper mold 2 integrally has an upper cast main part 2A that forms an inner upper surface of the cavity 7 and an upper mold base part 2B, the upper mold 2 can be raised and lowered by a drive mechanism (not shown), and the upper mold 2 comprises a mold release plate 9 provided with a plurality of mold release pins 9A passing vertically through the upper cast main part 2A. The mold release plate 9 can be raised and lowered by another drive mechanism separate from the drive mechanism of the upper mold.

At least one of the side molds 3 to 6 of the low-pressure casting apparatus according to the present invention can be advanced and retracted relative to a mold center. The side molds 3 to 6 of the illustrated example have side cast main parts 3A-6A that form an inner side surface of the cavity 7 and plates 3B to 6B disposed on back surfaces of the side cast main parts 3A to 6A. The side molds 3 to 6 are disposed on the four sides of the cavity 7, and can all be advanced and retracted relative to the mold center by a drive mechanism (not shown). The side molds 3 to 6 are disposed in positions corresponding to the sides of the square-shaped lower cast main part 1A.

By contrast, the lower mold base part 1B of the lower mold 1 has guide pillars 10 that restrict the advanced positions of the advanceable and retractable side molds 3 to 6, the guide pillars 10 being located at positions between adjacent side molds 3 to 6, outward of the four corners of the square-shaped lower cast main part 1A. When the side molds 3 to 6 have been advanced toward the mold center from the state shown in FIG. 1, the guide pillars 10 restrict the advanced positions of the side molds 3 to 6 due to contact being made therewith by the plates 3B to 6B of the side molds 3 to 6 as shown in FIG. 3.

In the low-pressure casting apparatus having the configuration described above, by advancing the side molds 3 to 6 and lowering the upper mold 2 from the mold-open state shown in FIGS. 1 and 2, the mold-closed state shown in FIGS. 3 and 4 is achieved and the cavity 7 is formed. The low-pressure casting apparatus then fills the cavity 7 with the molten metal in the holding furnace 50 through the stalk and the sprue bushes 8 by increasing pressure in the holding furnace 50 and reducing pressure in the cavity 7 as appropriate. After the molten metal has solidified, the molds are opened as shown in FIGS. 1 and 2, the mold release plate 9 is lowered relative to the upper mold 2, and the mold release pins 9A are caused to protrude from the upper mold 2 to release a cast article.

In the low-pressure casting apparatus during the casting described above, the lower cast main part 1A, which has the sprue bushes 8, correspondingly increases in temperature, and the lower cast main part 1A thermally expands in the horizontal direction. As a countermeasure, in the low-pressure casting apparatus, the lower mold 1 is divided into the lower cast main part 1A and the lower mold base part 1B and the adjustment gap S is provided therebetween; therefore, the thermal expansion of the lower cast main part 1A can be absorbed by the adjustment gap S and thermal deformation of the lower mold base part 1B is minimized.

As a result, in the low-pressure casting apparatus, displacement of the guide pillars 10 in the lower mold base part 1B is prevented, proper advanced positions of the advanceable and retractable side molds 3 to 6 can be ensured due to the guide pillars 10, and there will be no gaps larger than the clearance between the lower mold 1 and the side molds 3 to 6 or between the side molds 3 to 6 and the upper mold 2.

Thus, in the low-pressure casting apparatus, excessive gaps between casts due to thermal expansion of the lower mold 1 can be prevented, and an improvement in mold-closing accuracy can be realized. As a result, in the low-pressure casting apparatus, an improvement in dimensional accuracy of the cast articles can be realized along with the improvement in mold-closing accuracy, and it is possible to reduce the quantity of puncture defects particularly in casting using aluminum as a material.

FIGS. 5 to 9 illustrate second and third embodiments of the low-pressure casting apparatus according to the present invention. In the following embodiments, the same components as those in the first embodiment are denoted by the same symbols, and detailed descriptions thereof are omitted.

Second Embodiment

Figure 5:
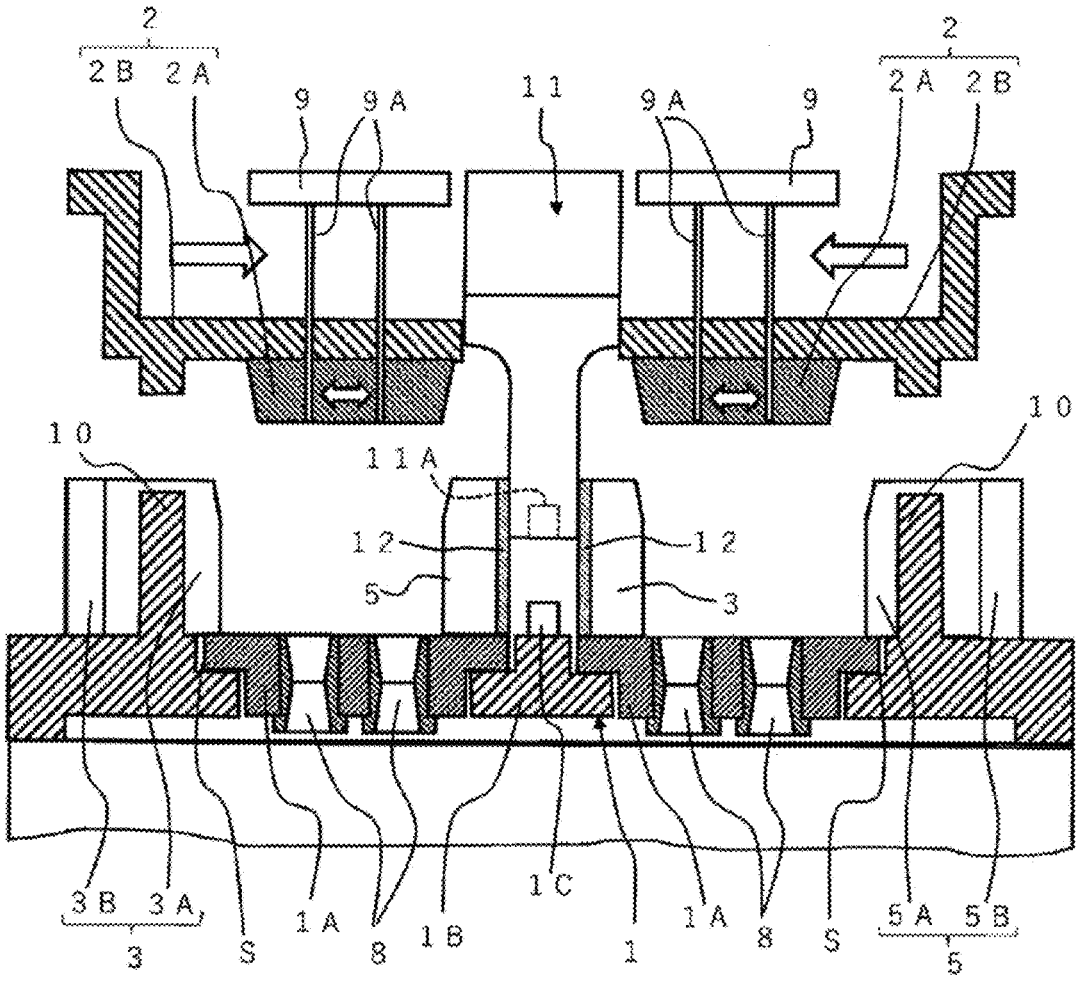
FIG. 5 is a vertical cross-sectional view of a mold-open state in a second embodiment of the low-pressure casting apparatus according to the present invention.
Figure 6:
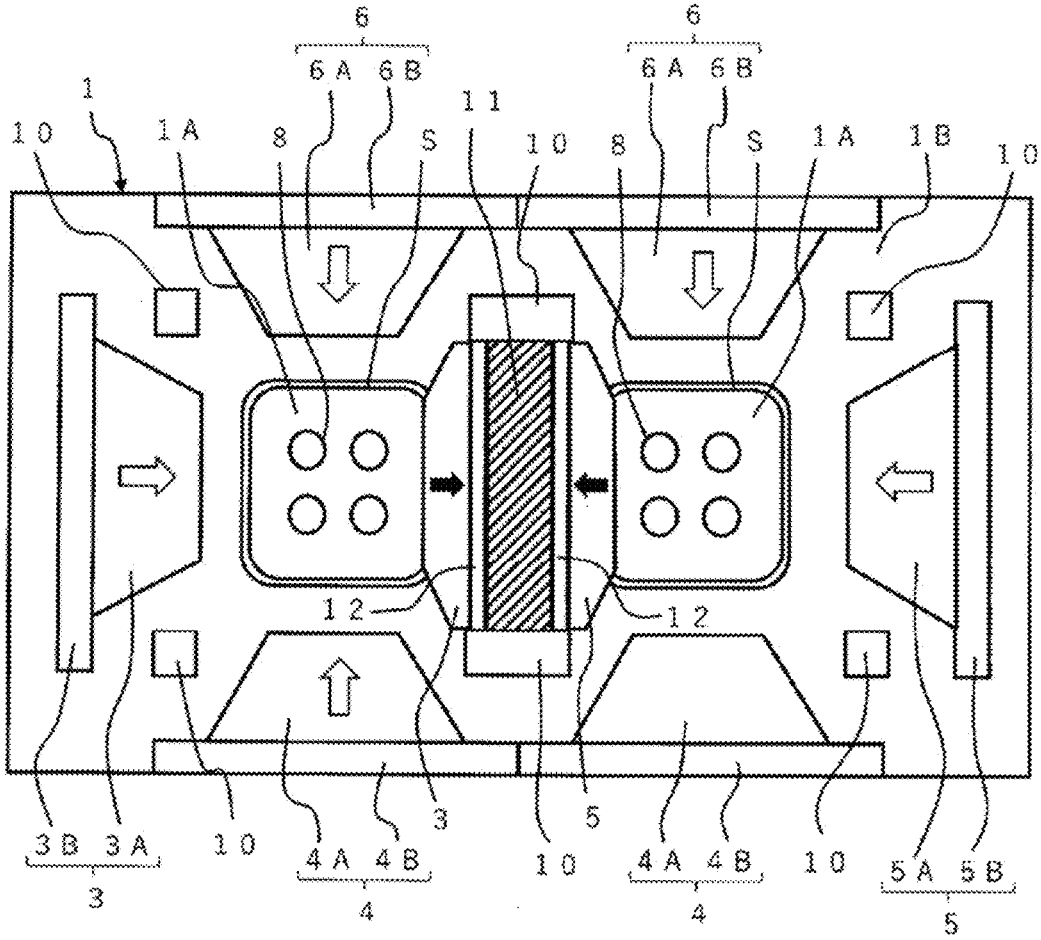
FIG. 6 is a plan view of a lower cast in a mold-open state.

The low-pressure casting apparatus shown in FIGS. 5 and 6 comprises a plurality (two in the illustrated example) of combinations of a lower mold 1, an upper mold 2, and a plurality of side molds 3 to 6. In this case, the lower mold 1 has two lower cast main parts 1A, but the lower mold base part 1B is shared. The upper mold 2 is divided into an upper cast main part 2A and an upper mold base part 2B that form an internal upper surface of a cavity 7, and the upper mold base part 2B holds the upper cast main part 2A such that the upper cast main part 2A can move back and forth in the direction in which the side molds 3 to 6 are aligned.

The upper cast main part 2A of the illustrated example can move back and forth in the direction in which the side molds 3 and 5 are aligned, which is the left-right direction in the drawings. The upper cast main part 2A is connected to the upper mold base part 2B by an elastic body or a slidable structure of recesses and protrusions, such as grooves and ridges. In this case, the range in which the upper cast main part 2A moves back and forth should be a range that allows for mold-closing. In the upper cast main part 2A and the upper mold base part 2B, insertion holes for the mold release pins 9A are formed into long holes in cross section in order to allow relative movement with the mold release pins 9A.

Furthermore, the low-pressure casting apparatus comprises a center base 11 on which at least one of the side molds is positioned. The center base 11 is a structure extending from between two upper mold base parts 2B, 2B to a lower mold 1, and the center base 11 positions two side molds 3 and 5 of which the back surfaces face each other, i.e., a right side mold 5 in the right-side group in FIG. 5 and a left side mold 3 in the left-side group in FIG. 5.

The center base 11 may be configured to be capable of being raised and lowered via a drive mechanism (not shown), and by causing a recess 11A provided at a lower end of the center base to engage with a protrusion 1C of the lower mold base part 1B, the center base 11 is positioned in the horizontal direction.

In the low-pressure casting apparatus, the center base 11 and the side molds 5 and 3 positioned by the center base 11 are separated from each other so that an adjustment shim 12 can be interposed therebetween. In other words, the opposing surfaces of the center base 11 and the side molds 3 and 5 are flat, and an adjustment shim 12 in the form of a flat plate can be interposed between the opposing surfaces.

The center base 11 can also constitute a center mold that includes the side molds 3 and 5. In this case, as with the lower mold 1 and the upper mold 2 described above, the side molds 3 and 5 are equivalent to side cast main parts (3A and 5A) that form the inner side surfaces of the cavity 7, and the center base 11 is equivalent to a center mold base part. This results in a structure in which the center mold is divided into side cast main parts (3 and 5) and center mold base part (11), and an adjustment shim 12 can be interposed therebetween.

In the low-pressure casting apparatus comprising the above configuration, as in the first embodiment, due to the adjustment gaps S provided between the lower cast main parts 1A and 1A and the lower mold base part 1B in the lower mold 1, thermal expansion of the lower cast main parts 1A and 1A can be absorbed to minimize thermal expansion of the lower mold base part 1B, and shifting of the positions of the guide pillars 10 and the advanced positions of the advanceable and retractable side molds 3, 4 and 6 can be prevented to satisfactorily maintain mold-closing accuracy.

In the low-pressure casting apparatus described above, the upper molds 2 are divided into upper cast main parts 2A and upper mold base parts 2B, the upper mold base parts 2B are pushed against the center base 11, and the upper cast main parts 2A can move back and forth relative to the upper mold base parts 2B.

Figure 7:
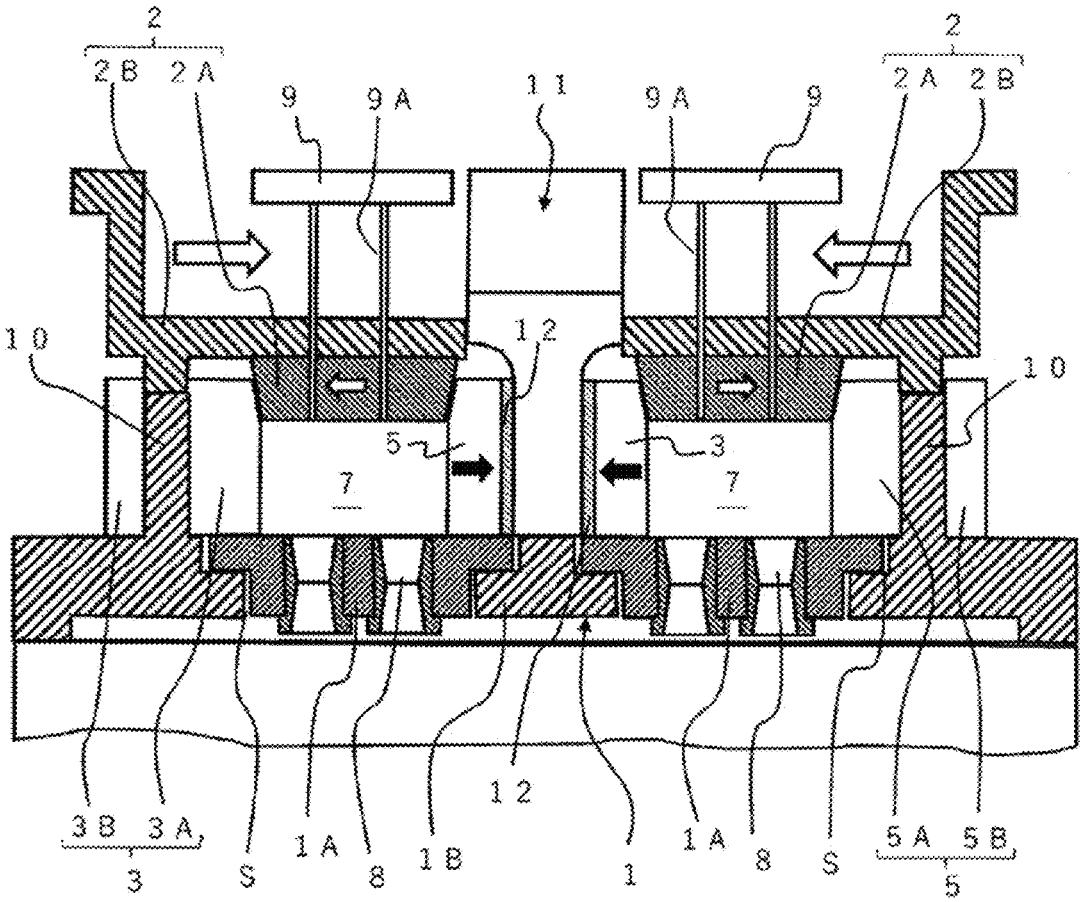
FIG. 7 is a vertical cross-sectional view, continuing from FIG. 5, of a mold-closed state.

This allows the upper cast main parts 2A of the low-pressure casting apparatus to move in opposite directions (the directions of the arrows) relative to the center base 11 during mold closing as shown in FIG. 7; therefore, the upper cast main parts 2A can be corrected to the proper mold-closing positions and further improvement in mold-closing accuracy can be realized.

Furthermore, by using the center base 11 and the adjustment shim 12 for positioning the two side molds 3 and 5 in the low-pressure casting apparatus described above, the positions of the side molds 3 and 5 can be adjusted, the other side molds and the upper cast main parts 2A can be closed with the fixed side molds 3 and 5 as a reference, and further improvement in mold-closing accuracy can therefore be realized.

Furthermore, in the low-pressure casting apparatus described above, the use of the center base 11 eliminates the need for drive mechanisms to position the side molds 3 and 5, and the entire apparatus can therefore be made smaller than when a plurality of casting apparatuses are simply arranged side by side.

Third Embodiment

Figure 8:
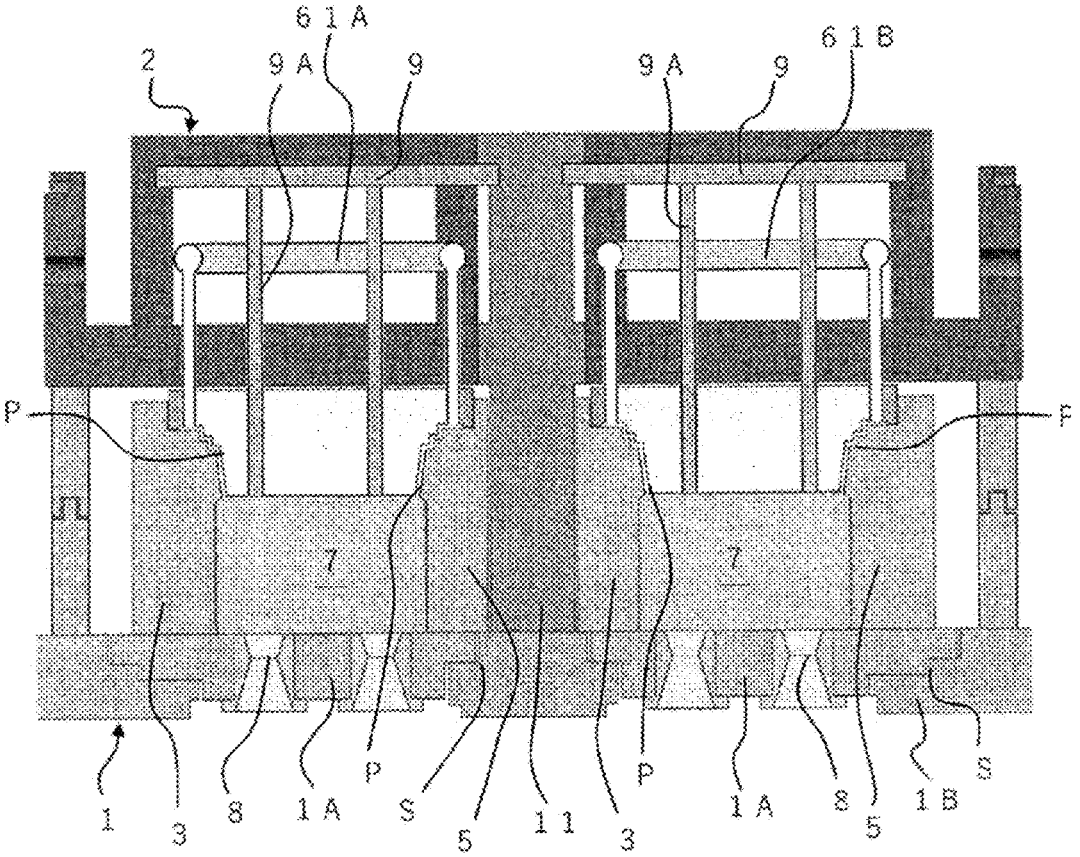
FIG. 8 is a vertical cross-sectional view of a mold-closed state in a third embodiment of the low-pressure casting apparatus according to the present invention.

The low-pressure casting apparatus shown in FIG. 8 has the same basic configuration as that of the second embodiment (FIGS. 5 to 7). Exhaust passages P for discharging air in the cavity 7 are located between the lower mold 1 and the side molds 3 and 5, and a suction mechanism 60 is provided to suction air out of the cavity 7 through the exhaust passages P.

Figure 9:
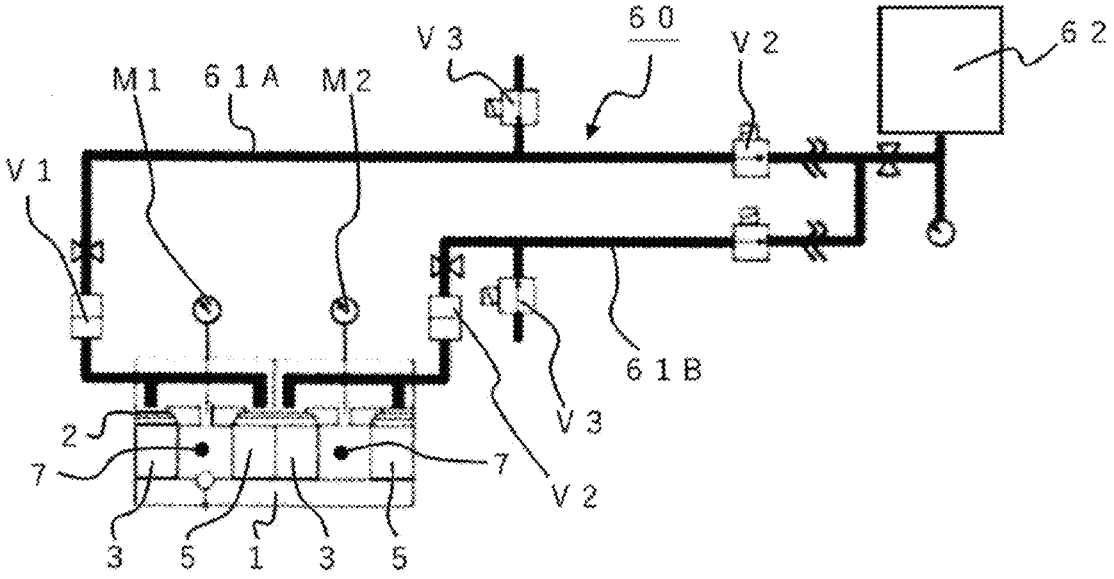
FIG. 9 is an explanatory circuit diagram of a suction mechanism of the low-pressure casting apparatus shown in FIG. 8.

Well-known chill vents may be used for the exhaust passages P. The suction mechanism 60, as shown in FIG. 9, has two exhaust pipes 61A and 61B, each connected to a respective exhaust passage P of the low-pressure casting apparatus. The exhaust pipes 61A and 61B are connected to a suction source 62 constituted of a vacuum pump or a vacuum tank, pressure adjustment valves V1, V2 and exhaust valves V3 are provided partway along the exhaust pipes, and the suction source 62 and the valves V1-V3 are controlled on the basis of values measured by pressure gauges M1, M2 for the cavities 7 and 7.

As described in the first and second embodiments, the low-pressure casting apparatus comprising the above configuration has favorable mold-closing accuracy, and it is therefore possible to differentiate between the exhaust passages P and the general clearance between molds. As a result, the low-pressure casting apparatus has no unnecessary gaps between molds, so the air in the cavity 7 can be intentionally suctioned out and discharged to a favorable degree using the exhaust passages P, and a degree of vacuum in the cavity 7 can be increased without enclosing the entire casting apparatus in a large housing. The low-pressure casting apparatus also enables low-pressure casting using a multi-cavity mold, and can favorably produce thin-walled castings.

The configuration of the low-pressure casting apparatus according to the present invention is not limited to only the embodiments above; changes can be made as appropriate within a range that does not deviate from the scope of the invention, and the present invention can naturally also be applied to castings or the like using a core.

The invention claimed is:

1. A low-pressure casting apparatus comprising:

a plurality of combinations of a lower mold, an upper mold, and a plurality of side molds, the plurality of combinations including at least a first combination and a second combination disposed adjacent to each other, the first combination having a first lower mold, a first upper mold, and a plurality of first side molds and the second combination having a second lower mold, a second upper mold, and a plurality of second side molds;

a holding furnace;

a center base disposed between one first side mold among the plurality of first side molds and one second side mold among the plurality of second side molds, the center base serving to position the one first side mold and the one second side mold, each of the combinations being configured such that the lower mold is disposed on the holding furnace, the upper mold is configured to be raised and lowered relative to the lower mold, and the plurality of side molds is disposed above the lower mold, a cavity is formed between the lower mold, the upper mold, and the plurality of side molds, the lower mold includes a lower cast main part forming an inner bottom surface of the cavity, and a lower mold base part holding the lower cast main part, the lower cast main part has a sprue bushing that opens into the cavity, at least one of the plurality of side molds is advanceable and retractable relative to a mold center, the lower mold base part having guide pillars that restrict advanced positions of the at least one of the plurality side molds, and a horizontal adjustment gap is provided between the lower cast main part and the lower mold base part, in each of the combinations, the upper mold including an upper cast main part and an upper mold base part, the upper cast main part forming an inner upper surface of the cavity and the upper mold base part holding the upper cast main part such that the upper cast main part is movable back and forth in a lateral direction perpendicular to a direction in which the upper mold is raised and lowered relative to the lower mold.

2. The low-pressure casting apparatus according to claim 1, further comprising the center base is spaced apart from at least one of the one first side mold and the one second side mold such that an adjustment shim can be interposed between the center base and the at least one of the one first side mold and the one second side mold.

3. The low-pressure casting apparatus according claim 1, wherein exhaust passages for discharging air in the cavity are located between the upper mold and the side molds of each of the combinations, and a suction mechanism is provided to suction air out of the cavity through the exhaust passages.

4. The low-pressure casting apparatus according to claim 1, wherein the lower cast main part has a downward-oriented step on an outer periphery thereof, the lower mold base part has an upward-oriented step on an inner periphery of a portion accommodating the lower cast main part, and the steps of the lower cast main part and the lower mold base part engage with one another.

5. The low-pressure casting apparatus according to claim 1, wherein the center base is also disposed between the first upper mold and the second upper mold.

* * * * *